US007428490B2

(12) United States Patent
Xu et al.

(10) Patent No.: US 7,428,490 B2
(45) Date of Patent: Sep. 23, 2008

(54) METHOD FOR SPECTRAL SUBTRACTION IN SPEECH ENHANCEMENT

(75) Inventors: Bo Xu, Beijing (CN); Liang He, Shanghai (CN); YiFei Zhu, Beijing (CN)

(73) Assignee: Intel Corporation, Santa Clara, CA (US)

( * ) Notice: Subject to any disclaimer, the term of this patent is extended or adjusted under 35 U.S.C. 154(b) by 781 days.

(21) Appl. No.: 10/673,570

(22) Filed: Sep. 30, 2003

(65) Prior Publication Data

US 2005/0071156 A1 Mar. 31, 2005

(51) Int. Cl.
*G10L 21/02* (2006.01)

(52) U.S. Cl. ..... 704/226

(58) Field of Classification Search ..... 704/226, 704/213, 225

See application file for complete search history.

(56) References Cited

U.S. PATENT DOCUMENTS 5,206,884 A * 4/1993 Bhaskar ..... 375/254
5,706,395 A * 1/1998 Arslan et al. ..... 704/226
5,757,937 A * 5/1998 Itoh et al. ..... 381/94.3
6,070,137 A * 5/2000 Bloebaum et al. ..... 704/227
6,144,937 A * 11/2000 Ali ..... 704/233
6,289,309 B1 * 9/2001 deVries ..... 704/233
2002/0123886 A1 * 9/2002 Globerson ..... 704/219

* cited by examiner

*Primary Examiner*—Abul Azad
(74) *Attorney, Agent, or Firm*—Guojun Zhou

(57) ABSTRACT

A method and system is provided for enhancing an audio signal based on spectral subtraction. The noise power spectrum for each frame of an audio signal is dynamically estimated based on a plurality of signal power spectrum values computed from a corresponding plurality of adjacent frames. An over-subtraction factor is then dynamically computed for each frame based on the noise power spectrum estimated for the frame. The signal power spectrum of the audio signal at each frame is then reduced in accordance with the over-subtraction factor computed for the corresponding frame.

29 Claims, 11 Drawing Sheets

METHOD FOR SPECTRAL SUBTRACTION IN SPEECH ENHANCEMENT

BACKGROUND

1. Field of Invention

The inventions described and claimed herein relate to methods and systems for audio signal processing. Specifically, they relate to methods and systems that enhance audio signals and systems incorporating these methods and systems.

2. Discussion of Related Art

Audio signal enhancement is often applied to an audio signal to improve the quality of the signal. Since acoustic signals may be recorded in an environment with various background sounds, audio enhancement may be directed at removing certain undesirable noise. For example, speech recorded in a noisy public environment may have much undesirable background noise that may affect both the quality and intelligibility of the speech. In this case, it may be desirable to remove the background noise. To do so, one may need to estimate the noise in terms of its spectrum; i.e. the energy at each frequency. Estimated noise may then be subtracted, spectrally, from the original audio signal to produce an enhanced audio signal with less apparent noise.

There are various spectral subtraction based audio enhancement techniques. For example, segments of audio signals where only noise is thought to be present are first identified. To do so, activity periods in the time domain may first be detected where activity may include speech, music, or other desired acoustic signals. In periods where there is no detected activity, the noise spectrum can then be estimated from such identified pure noise segments. A replica of the identified noise spectrum is then subtracted from the signal spectrum. When the estimated noise spectrum is subtracted from the signal spectrum, it results in the well-known musical tone phenomenon, due to those frequencies in which the actual noise was greater than the noise estimate that was subtracted. In some traditional spectral subtraction based methods, over-subtraction is employed to overcome this musical tone phenomenon. By subtracting an over-estimate of the noise, many of the remaining musical tones are removed. In those methods, a constant over-subtraction factor is usually adopted. For example, an over-subtraction factor of 3 may be used meaning that the spectrum subtracted from the signal spectrum is three times the estimated noise spectrum in each frequency.

BRIEF DESCRIPTION OF THE DRAWINGS

The inventions claimed and/or described herein are described in terms of exemplary embodiments. These exemplary embodiments are described in detail with reference to drawings which are part of the descriptions of the inventions. These embodiments are non-limiting exemplary embodiments, in which like reference numerals represent similar structures throughout the several views of the drawings, and wherein:

FIG. 2(*b*) illustrates the relationship between a frame and a hamming window;

DETAILED DESCRIPTION

Figure 1:
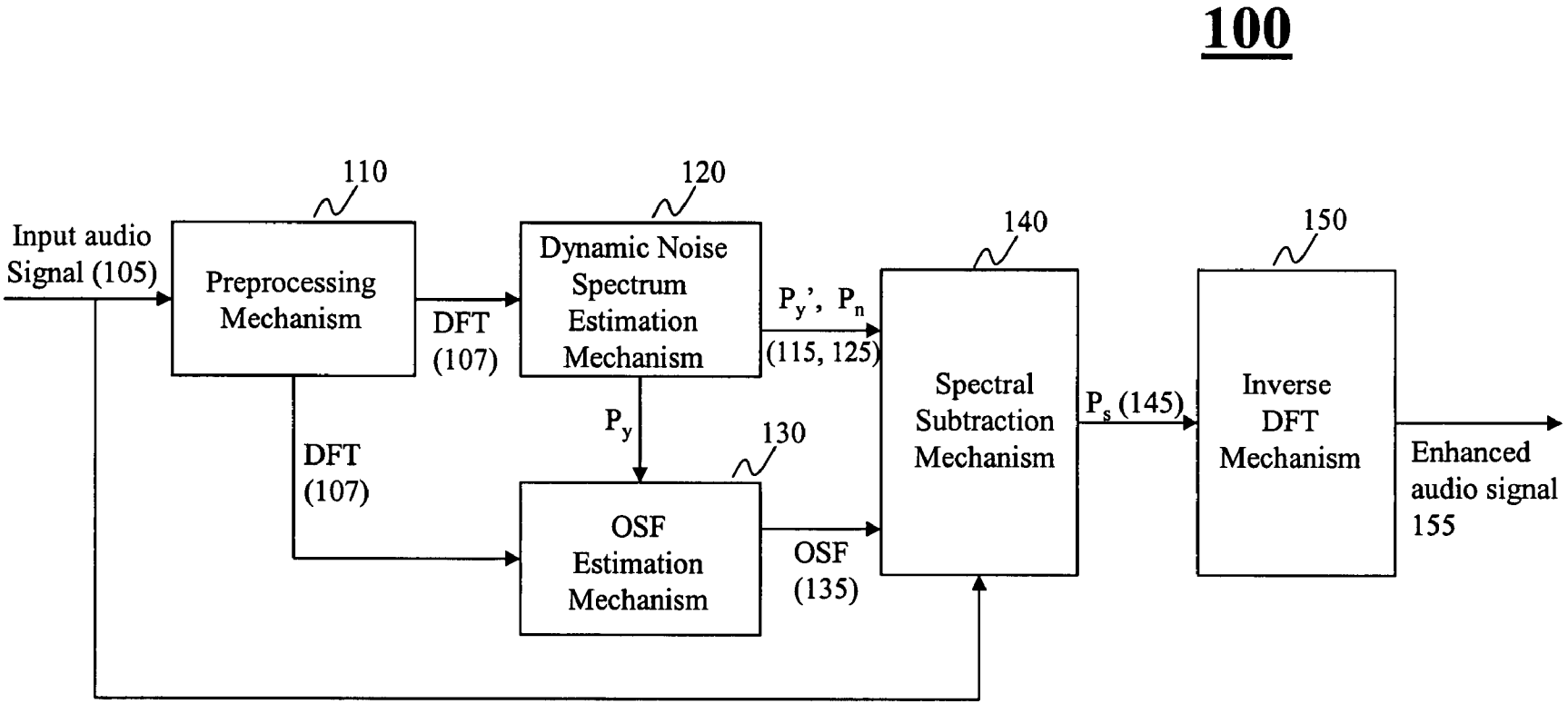
FIG. 1 depicts an exemplary internal structure of a spectral subtraction based audio enhancer, according to at least one embodiment of the inventions.

The inventions are related to methods and systems to perform spectral subtraction based audio enhancement and systems incorporating these methods and systems. FIG. 1 depicts an exemplary internal structure of a dynamic spectral subtraction based audio enhancer 100, according to at least one embodiment of the inventions. The dynamic spectral subtraction based audio enhancer 100 receives an input audio signal 105 from an external source and produces an enhanced audio signal 155 as its output. The dynamic spectral subtraction based audio enhancer 100 attempts to improve the input audio signal 105 by reducing the noise present in the input audio signal without degrading the portion corresponding to non-noise. This may be performed through subtracting a certain level of the power spectrum considered to be related to noise.

The dynamic spectral subtraction based audio enhancer 100 may comprise a preprocessing mechanism 110, a noise spectrum estimation mechanism 120, an over-subtraction factor (OSF) estimation mechanism 130, a spectral subtraction mechanism 140, and an inverse discrete Fourier transform (DFT) mechanism 150. The preprocessing mechanism 110 may preprocess the input audio signal 105 to produce a signal in a form that facilitates later processing. For example, the preprocessing mechanism 110 may compute the DFT 107 of the input audio signal 105 before such information can be used to compute the signal power spectrum corresponding to the input signal. Details related to exemplary preprocessing are discussed with reference to FIGS. 2(*a*) and 2(*b*).

The noise spectrum estimation mechanism 120 may take the preprocessed signal such as the DFT of the input audio signal 107 as input to compute the signal power spectrum ($P_y$ 115) and to estimate the noise power spectrum ($P_n$ 125) of the input audio signal. The signal power spectrum is the energy of the input audio signal 105 in each of several frequencies. The noise power spectrum is the power spectrum of that part of the signal in the input audio signal that is considered to be noise. For example, when speech is recorded, the background sound from the recording environment of the speech may be considered to be noise. The recorded audio signal in this case may then be a compound signal containing both speech and noise. The energy of this compound signal corresponds to the signal power spectrum. The noise power spectrum $P_n$ 125 may be estimated based on the signal power spectrum $P_y$ 115 computed based on the input audio signal 105. Details related to noise spectrum estimation are discussed with reference to FIGS. 3, 4(*a*), and 4(*b*).

The estimated noise power spectrum $P_n$ 125 may then be used by the OSF estimation mechanism 130 to determine an over-subtraction factor OSF 135. Such an over-subtraction factor may be computed dynamically so that the derived OSF 135 may adapt to the changing characteristics of the input audio signal 105. Further details related to the OSF estimation mechanism 130 are discussed with reference to FIG. 5.

The continuously derived dynamic over-subtraction factors may then be fed to the spectral subtraction mechanism 140 where such over-subtraction factors are used in spectral subtraction to produce a subtracted signal 145 that has a lower energy. Further details related to the spectral subtraction mechanism 140 are described with reference to FIG. 6. To generate an enhanced audio signal 155, the inverse DFT mechanism 150 may then transform the subtracted signal 145 to produce a signal that may have lower noise.

Figure 2A:
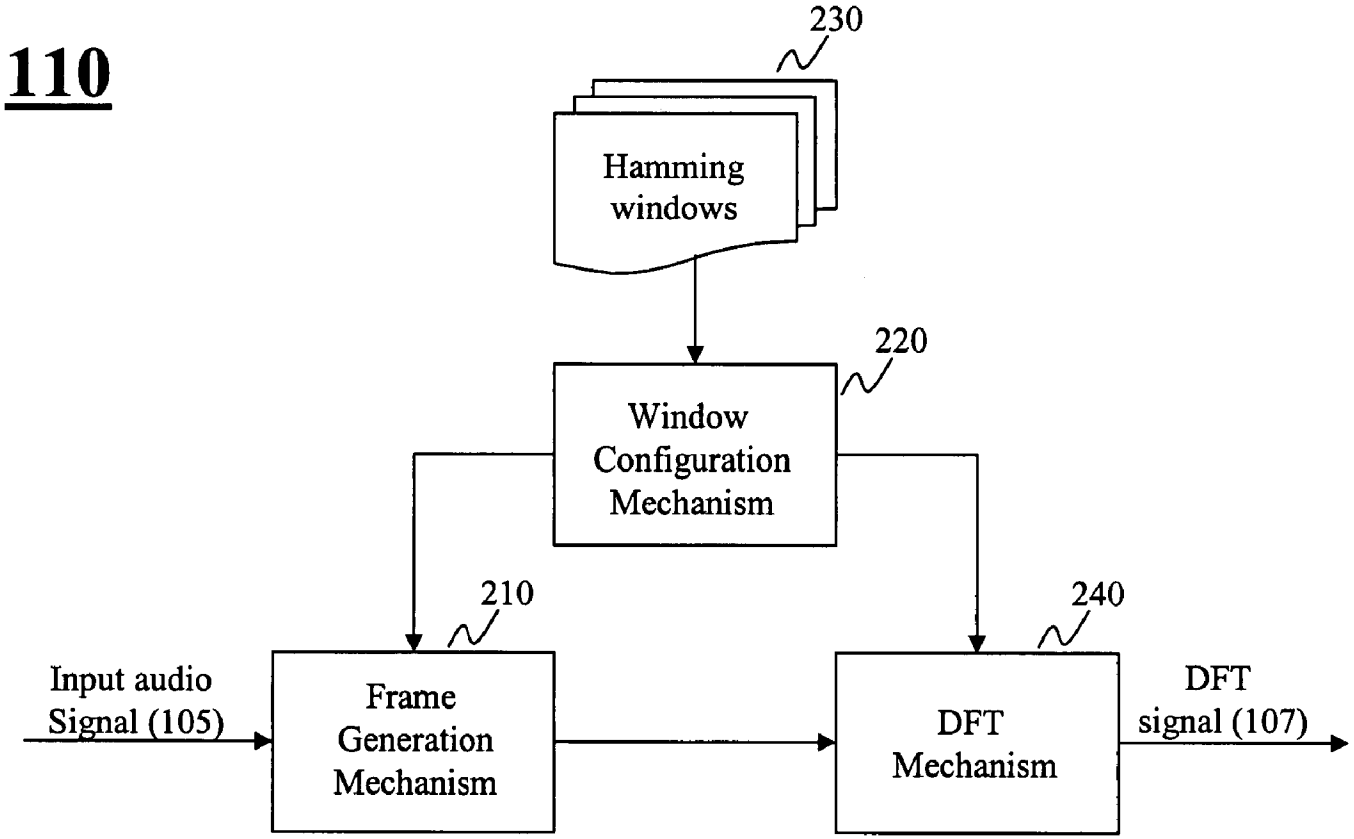
FIG. 2(*a*) is an exemplary functional block diagram of a preprocessing mechanism for audio enhancement, according to an embodiment of the inventions.
Figure 2B:
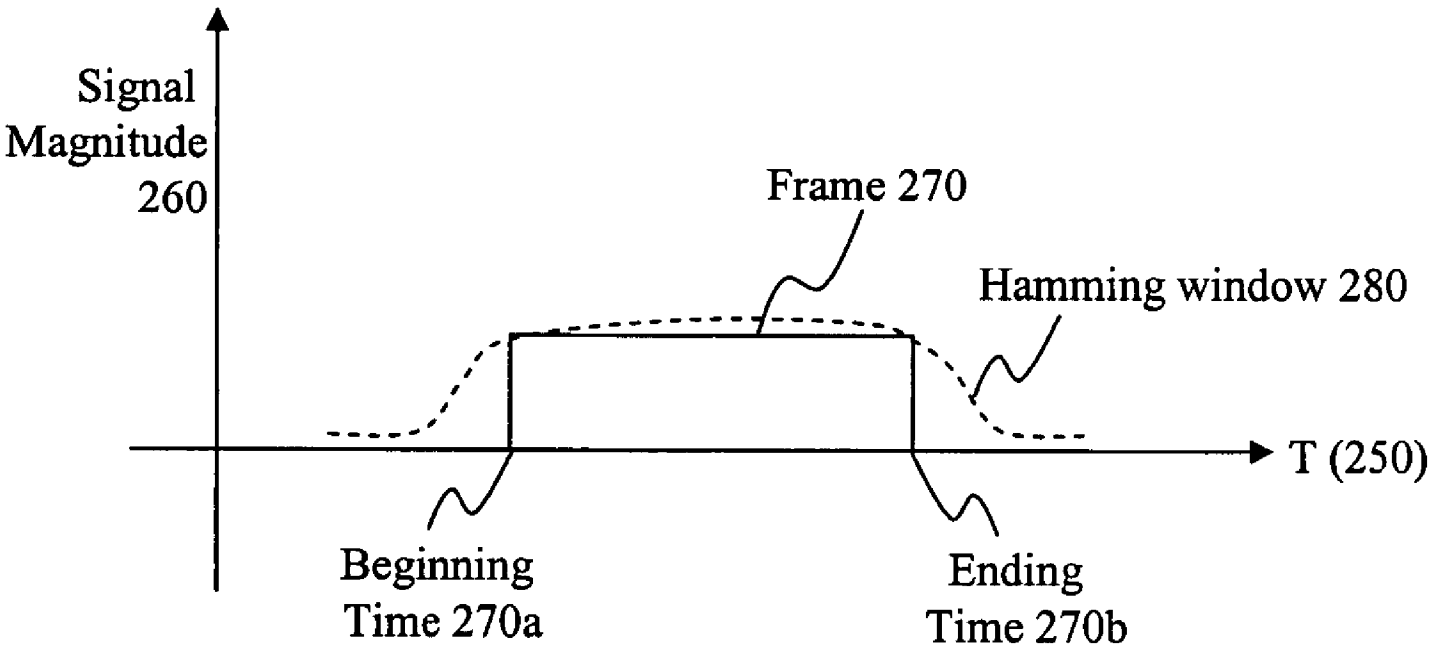

FIG. 2(*a*) depicts an exemplary functional block diagram of the preprocessing mechanism 110, according to an embodiment of the inventions The exemplary preprocessing mechanism 110 comprises a signal frame generation mechanism 210 and a DFT mechanism 240. The frame generation mechanism 210 may first divide the input audio signal 105 into equal length frames as units for further computation. Each of such frames may typically include, for example, 200 samples per frame and there may be 100 frames per second. The granularity of the division may be determined according to computation requirement or application needs.

To reduce the analysis effect near the boundary of each frame, a Hamming window can optionally be applied to each frame. This is illustrated in FIG. 2(*b*). The x-axis in FIG. 2(*b*) represents time 250 and the y-axis represents the magnitude of the input audio signal 105. A frame 270 has an abrupt beginning at time 270*a* and an abrupt ending at time 270*b* and this may introduce undesirable effects when, for example, a DFT is computed based on signal values in each frame. An appropriate window may be applied to reduce such undesirable effect. For example, a Hamming window with a raised cosine may be used which is illustrated in FIG. 2(*b*). Such a window may be expressed as:

$$W(n) = 0.54 - 0.46 \times \cos\left(\frac{2 \times \pi \times n}{N-1}\right)$$

Where N is the number of samples in the window. It may be seen that this Hamming window with a raised cosine has gradually decreasing values near both the beginning time 270*a* and the ending time 27*b*. When applying such a window to each frame, the signal values in each frame are multiplied with the value of the window at the corresponding locations and then the multiplied signal values may be used in further computation (e.g., DFT).

It will be appreciated by those skilled in the art that other alternative windows other than the illustrated Hamming window with a raised cosine function may also be used. Alternative windows may include, but not be limited to, a cosine function, a sine function, a Gaussian function, a trapezoidal function, or an extended Hamming window that has a plateau between the beginning time and the ending time of an underlying frame.

The preprocessing mechanism 110 may also optionally include a window configuration mechanism 220 which may store a pre-determined configuration in terms of which window to apply. Such configuration may be made based on one or more available windows stored in 230. With these optional components (220 and 230), the configuration may be changed when needed. For example, the window to be applied to divide frames may be changed from a cosine to a raised cosine. The frame generation mechanism 210 may then simply operate according to the configuration determined by the window configuration mechanism 220.

The DFT mechanism 240 may be responsible for converting the input audio signal 105 from the time domain to the frequency domain by performing a DFT. This produces DFT signal 107 of the input audio signal 105 which may then be used for estimating noise spectrum.

Figure 3:
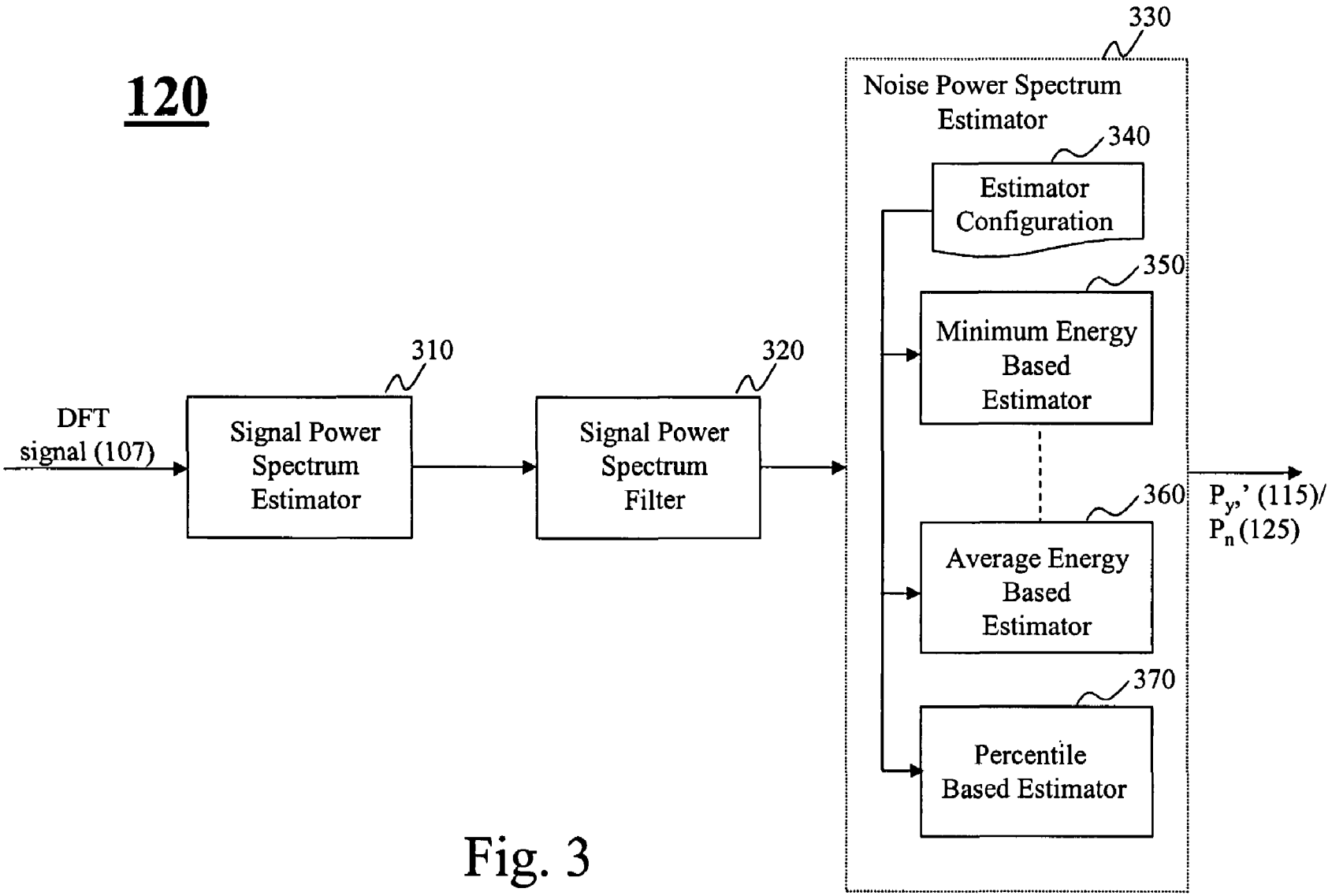
FIG. 3 is an exemplary functional block diagram of a noise spectrum estimation mechanism, according to at least one embodiment of the inventions.

FIG. 3 depicts an exemplary functional block diagram of the noise spectrum estimation mechanism 120, according to at least one embodiment of the inventions. The noise power spectrum estimation mechanism 120 may include a signal power spectrum estimator 310 and a noise power spectrum estimator 330. It may also optionally include a signal power spectrum filter 320 which is responsible for smoothing the computed signal power spectrum prior to estimating the noise spectrum.

The illustrated signal power spectrum estimator 310 may take the DFT signal 107 to derive a periodogram or signal power spectrum. Alternatively, the signal power spectrum may also be computed through other means. For example, the auto-correlation of the input audio signal may be computed based on which the inverse Fourier transform may be applied to obtain the signal power spectrum. Any known technique may be used to obtain the signal power spectrum of the input audio signal.

The computed signal power spectrum may change quickly due to, for example, noise (e.g., the power spectrum of speech may be stable but the background noise may be random and hence have a sharply change spectrum). The noise power spectrum estimation mechanism 120 may optionally smooth the computed signal power spectrum via the signal power spectrum filter 320. Such smoothing may be achieved using a low pass filter. For example, a linear low pass filter may be employed. Alternatively, a non-linear low pass filter may also be used to achieve the smoothing. Such employed low pass filter may be configured to have a certain window size such as 2, 3, or 5. There may be other parameters that are applicable to a low pass filter. One exemplary filter with a window size of 2 and with a weight parameter $\lambda$ is shown below:

$$P_y(r,w)' = \lambda P_y(r-1,w) + (1-\lambda) P_y(r,w)$$

where r denotes time, w denotes subband frequency, $P_y$ (r,w) denotes the energy of subband frequency w at time r, $P_y$ (r−1,w) denotes the energy of subband frequency w at time r−1, and $P_y$ (r,w)' corresponds to the filtered energy of subband w at time r. Here, the smoothed signal power spectrum of subband frequency w at time r is a linear combination of the signal power spectrum of the same frequency at times r−1 and r weighted according to parameter $\lambda$. It should be appreciated that many known smoothing techniques may be employed to achieve the similar effects and the choice of a particular technique may be determined according to application needs or the characteristics of the audio data.

The filtered signal power spectrum may then be forwarded to the noise power spectrum estimator 330 to estimate the corresponding noise power spectrum. In one embodiment of the inventions, the noise power spectrum may be computed based on the minimum signal power spectrum across a plurality of frames. For instance, the noise energy of each subband frequency may be derived as the minimum noise energy of the same subband frequency among M frames as shown below:

$$P_n(r;w)=\min(P_y(r;w)',P_y(r-1,w)',\ldots,P_y(r-M+1,w)')$$

Where M is an integer.

Figure 4A:
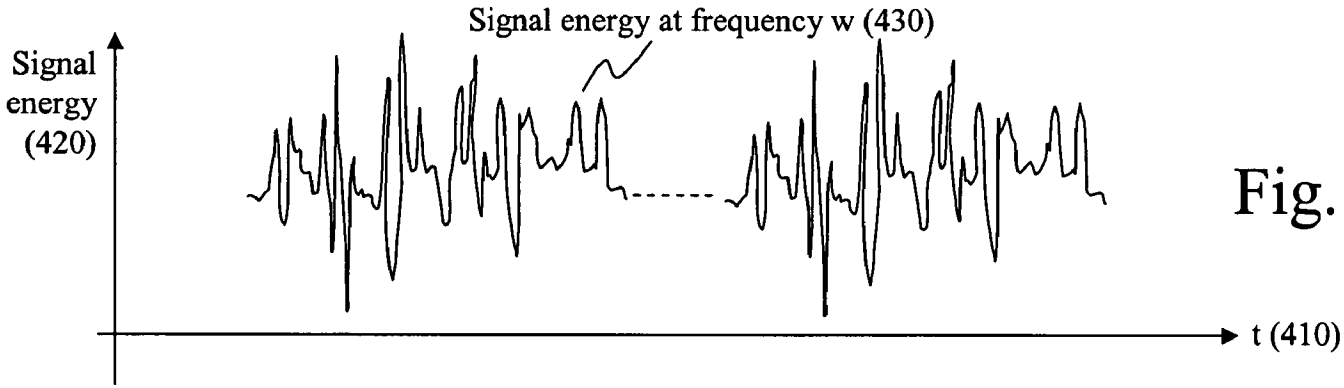
FIGS. 4(*a*) and 4(*b*) describe an exemplary scheme to estimate noise power spectrum based on computed minimum signal power spectrum, according to an embodiment of the inventions.
Figure 4B:
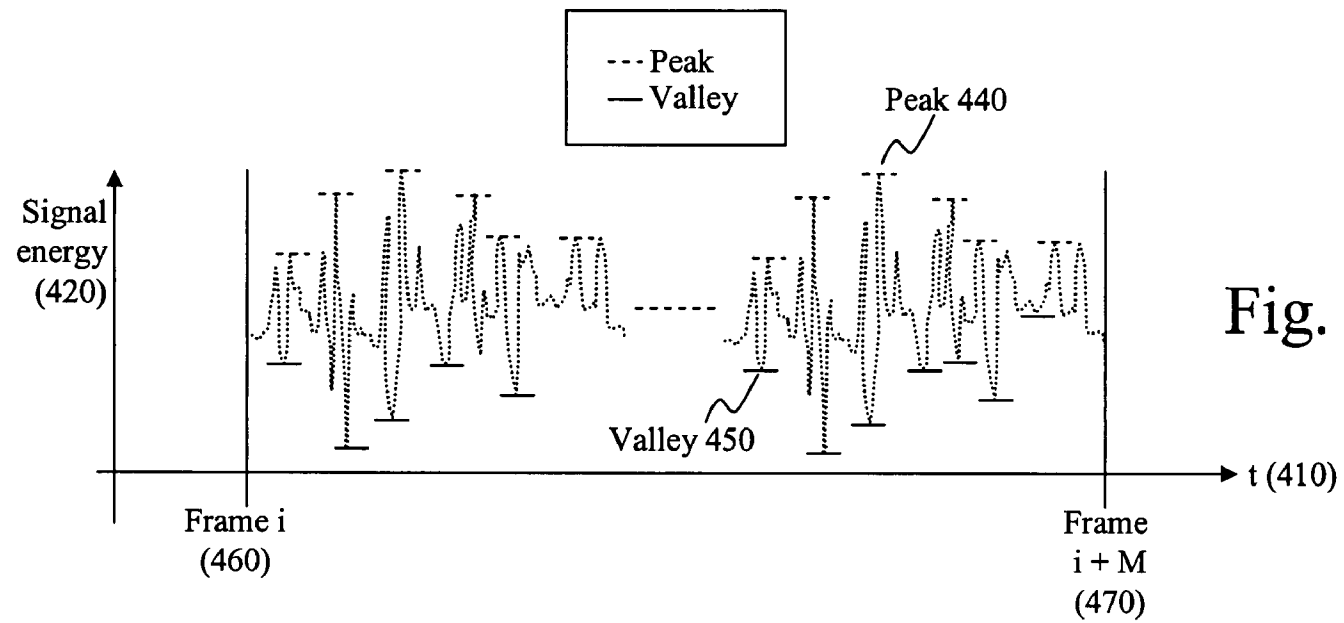

FIGS. 4(*a*) and 4(*b*) illustrate this exemplary scheme to estimate the noise power spectrum based on the minimum signal power spectrum selected across a predetermined number of frames, according to an embodiment of the inventions. FIG. 4(*a*) shows a signal energy envelope (430) in a plot with the x-axis representing time (410) and the y-axis representing signal energy (420) measured for subband frequency w. FIG. 4(*b*) shows marked peaks and valleys of the measured signal energy in M frames (between frame i–M+1 460 and frame i 470). According to the above-described estimation method, a minimum among all valleys may then be selected as an estimate for the noise energy at subband frequency w.

Using this minimum based estimation method, there is no need to use a voice activity detector to estimate where the noise may be located in the input audio signal 105. Alternatively, there may be other means by which the noise power spectrum may be estimated without using a voice activity detector. For example, instead of using a minimum, an average computed across a certain number of the smallest signal energy values may be used. For instance, if M is 50, an average of the five smallest signal energy values corresponds to the 10 percent lowest signal energy values. This alternative method to estimate the noise energy may be more robust against outliers. As another alternative, the $10^{th}$ percentile of the computed energy may also be used as an estimate of the noise energy. Using a percentile instead of an average may further reduce the possible undesirable effect of outliers.

The noise power spectrum estimator 330 may be capable of performing any one of (but not limited to) the above illustrated estimation methods. For example, a minimum energy based estimator 350 may be configured to perform the estimation using a minimum energy selected from M frames. Alternatively, an average energy based estimator 360 may be configured to perform the estimation using an average computed based on a pre-determined number of smallest energy values from M frames. In addition, a percentile based estimator 370 may be configured to perform the estimation based on a pre-determined percentile. Various estimation parameters such as which method (e.g., minimum energy based, average energy based, and percentile based) to be used to perform the estimation and the associated parameters (e.g., the number of frames M, the pre-determined certain percentage in computing the average, and the percentile) to be used in computing the estimate may be pre-configured in an estimation configuration 340. Such configuration 340 may also be updated dynamically based on needs.

To estimate the noise power spectrum, a voice activity detector may also be used to first locate where the pure noise is and then to estimate the noise power spectrum from such identified locations (not shown). The noise power spectrum estimator 330 may then output both the computed signal power spectrum $P_y$ 115 and the estimated noise power spectrum $P_n$ 125.

Figure 5:
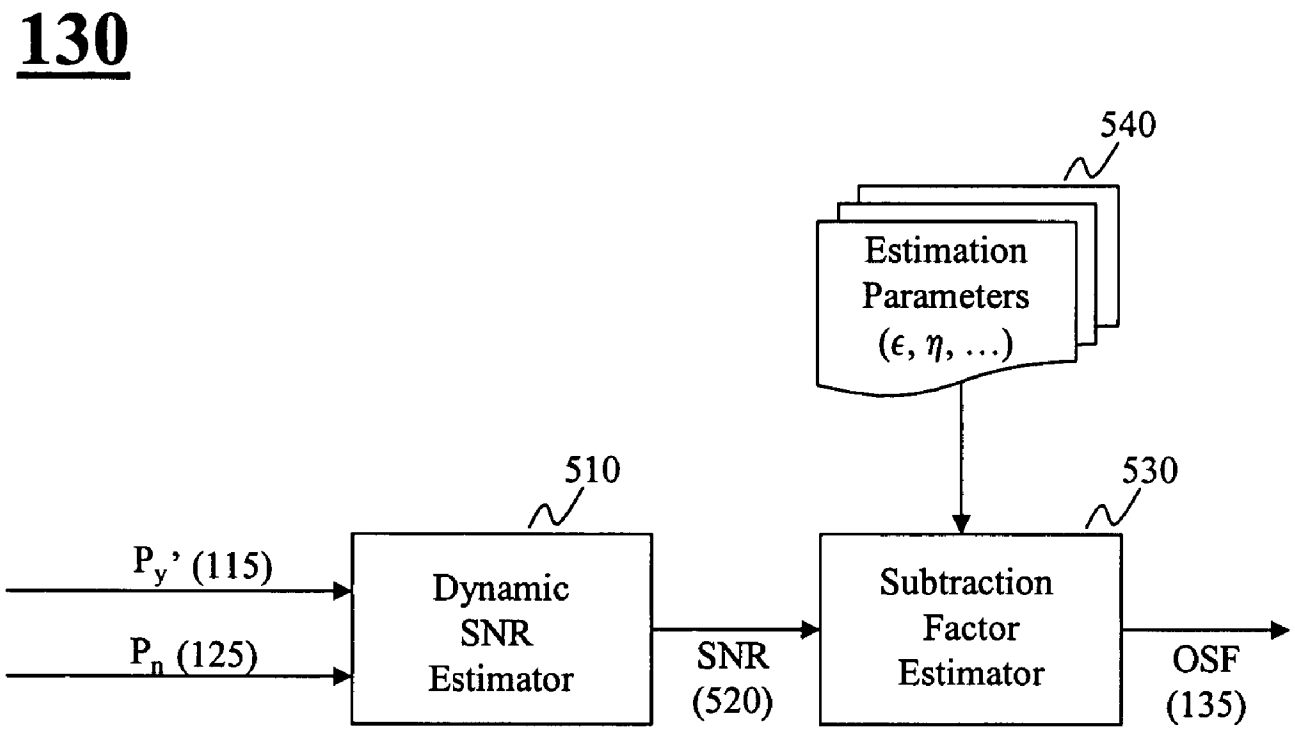
FIG. 5 is an exemplary functional block diagram of a over-subtraction factor estimation mechanism, according to at least one embodiment of the inventions.

FIG. 5 depicts an exemplary functional block diagram of the over-subtraction factor estimation mechanism 130, according to at least one embodiment of the inventions. According to the inventions, the over-subtraction factor is dynamically estimated. Such estimation may be performed on the fly. The OSF estimation mechanism 130 may take both the computed signal power spectrum $P_y$ 115 and the estimated noise power spectrum $P_n$ 125 as input and produce an OSF for each frame denoted as $P_s$ (r) as output. Each $P_s$ (r) may be estimated adaptively based on the signal-to-noise ratio (SNR) estimated with respect to frame r.

The OSF estimation mechanism 130 comprises a dynamic SNR estimator 510, which dynamically computes or estimates signal-to-noise ratio 520 of each frame, and a subtraction factor estimator 530 that computes an OSF based on the dynamically estimated signal-to-noise ratio 520. The dynamic SNR estimator 510 may compute the SNR of each frame according to, for example, the following formulation:

$$SNR(r) = 10\log\left(\frac{\sum_w P_y(r,w) - \sum_w P_n(r,w)}{\sum_w P_n(r,w)}\right)$$

Other alternative ways to compute SNR(r) may also be employed.

With a dynamically computed SNR(r) (520) for frame r, the corresponding over-subtraction factors OSF(r) (135) may be accordingly computed using, for example, the following formula:

$$OSF(r) = \frac{\varepsilon}{1+\eta SNR(r)}$$

where $\epsilon$ and $\eta$ are estimation parameters (540) that may be pre-determined and pre-stored and may be dynamically reconfigured when needed.

Figure 6:
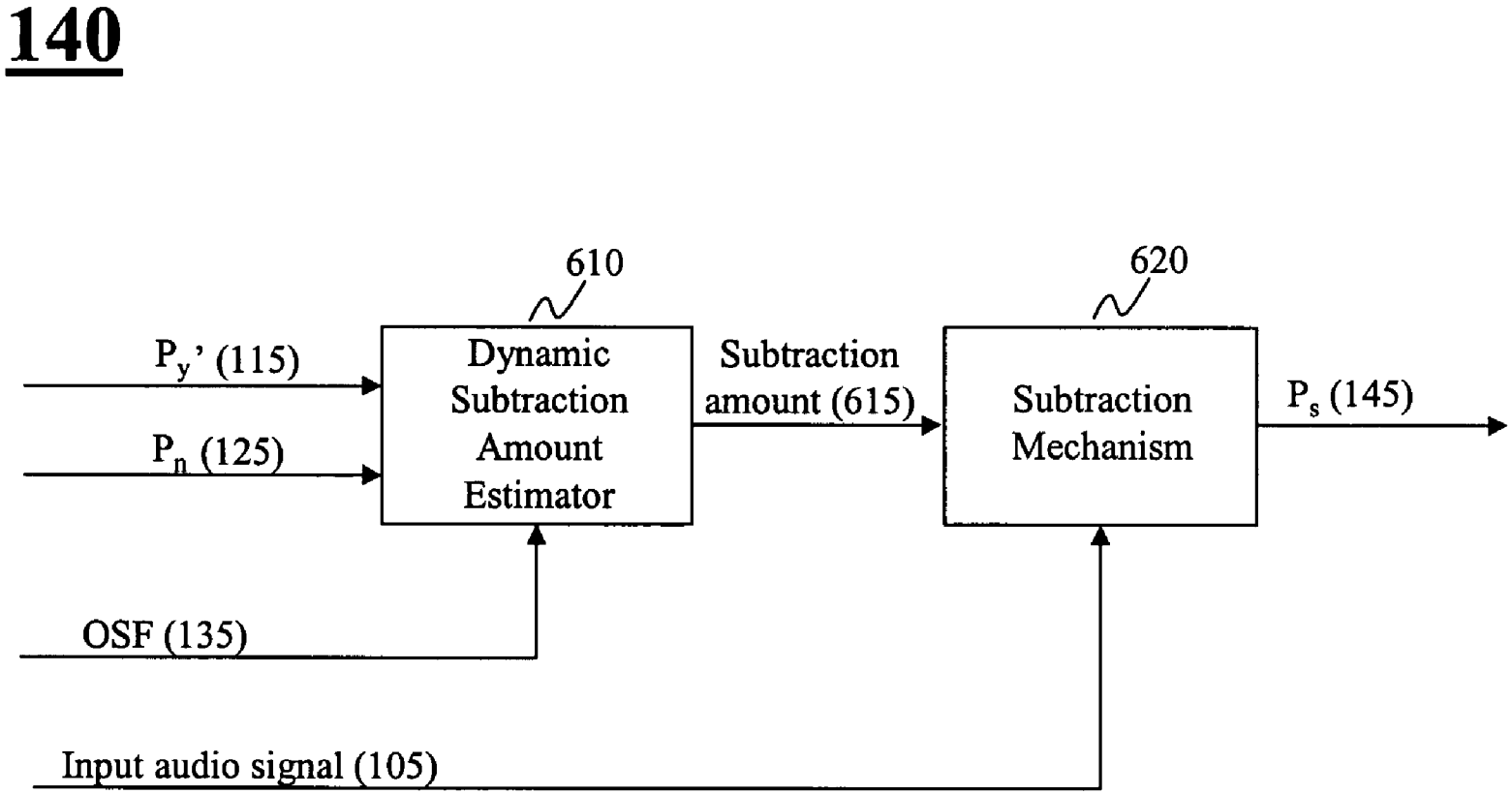
FIG. 6 is an exemplary functional block diagram of a spectral subtraction mechanism, according to an embodiment of the inventions.

FIG. 6 depicts an exemplary functional block diagram of the spectral subtraction mechanism 140, according to an embodiment of the inventions. The spectral subtraction mechanism 140 comprises a dynamic subtraction amount estimator 610 and a subtraction mechanism 620. The dynamic subtraction amount estimator 610 may calculate, for each frame and each subband frequency (e.g., frame r and subband frequency w), a dynamic over-subtraction amount (615) based on the corresponding over-subtraction factor OSF(r) for the same frame. The subtraction amount 615 for frame r at subband frequency w may be computed based on the smoothed signal energy in subband frequency w of frame r, $P_y$ (r,w) (115), the estimated noise energy in subband frequency w of frame r, $P_n$ (r,w) (125), and the estimated over-subtraction factor for the frame r, OSF(r). For instance, such calculated amount may be calculated as:

$$OSF(r)\times P_n(r,w)$$

which is specific to both the underlying frame and frequency and may differ from frame to frame. The computed subtraction amount may then be used, by the subtraction mechanism 620, to produce an updated signal energy $P_s$ (r,w) (145) by subtracting, if appropriate, the estimated over-subtraction amount from the corresponding signal energy $P_y(r,w)$ according to, for example, the following condition:

$$P_s(r, w) = \begin{cases} P'_y(r, w) - OSF(r) \times P_n(r, w) & \text{if } P'_y(r, w) - OSF(r) \times P_n(r, w) > 0 \\ \sigma & \text{if } P'_y(r, w) - OSF(r) \times P_n(r, w) \leq 0 \end{cases}$$

where σ is a small energy value, which may be chosen as a multiple of the estimated noise spectrum. To mask remaining musical tones, the value of σ may be chosen to be non-zero. To generate the enhanced audio signal 155 (see FIG. 1), the updated signal energy values $P_s$ (r,w) (145) for different frames and frequencies are then used, together with the phase information of the input audio signal 105, in an inverse DFT operation using, for example, the following formula:

$$S'(r)=IDFT(\sqrt{P_s(r,w)}\times e^{j\theta(r,w)})$$

where θ(r,w) corresponds to the phase of subband frequency w at frame r.

Figure 7:
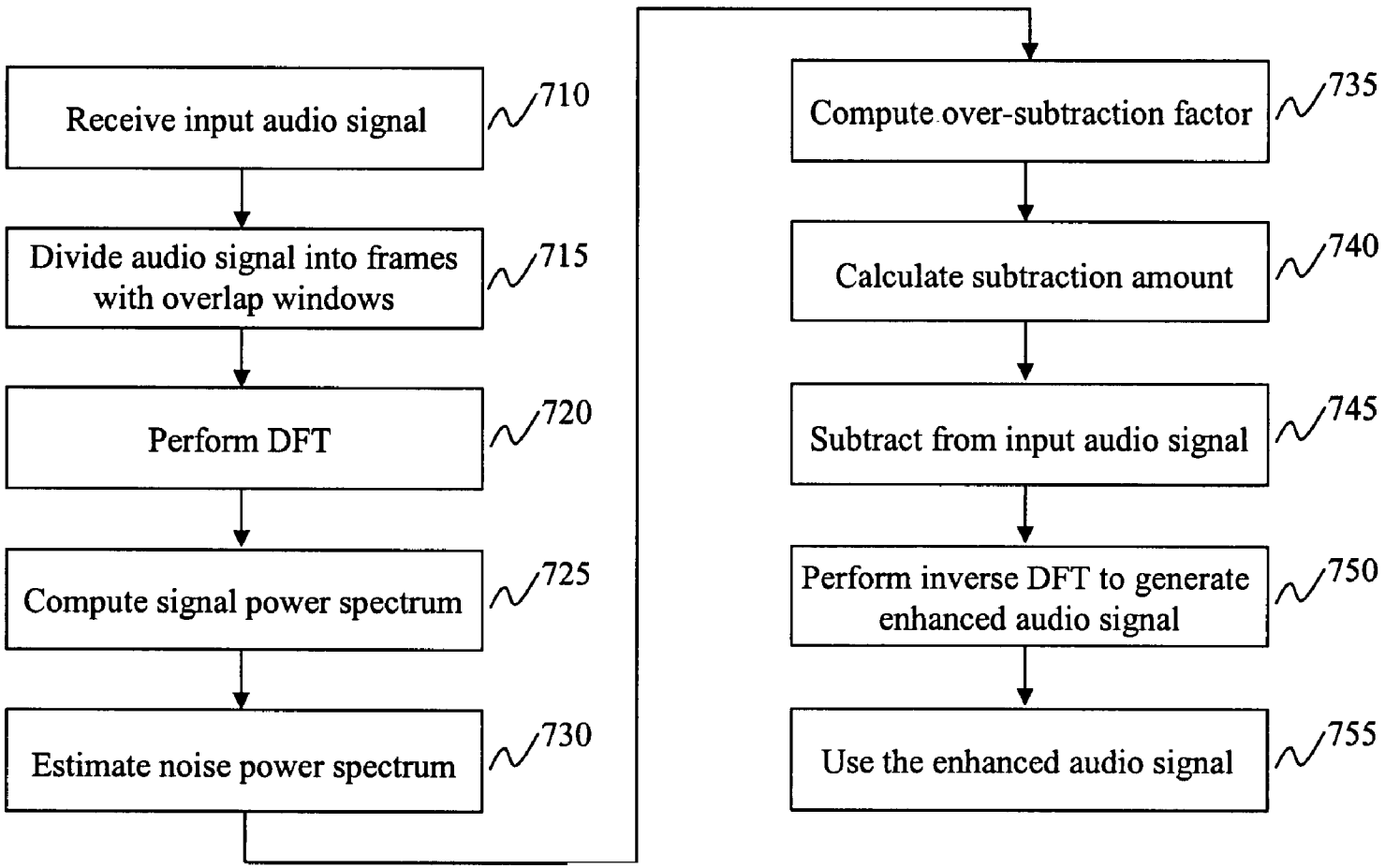
FIG. 7 is a flowchart of an exemplary process, in which an audio signal is enhanced using a dynamic spectral subtraction approach prior to its use, according to at least one embodiment of the inventions.

FIG. 7 is a flowchart of an exemplary process, in which an audio signal is enhanced, prior to its use, using the above-described dynamic spectral subtraction method, according to at least one embodiment of the inventions. The input audio signal is first received at 710. To perform spectral subtraction based enhancement, the audio signal may be divided, at 715, into preferably equal length frames and overlapping windows are applied to the frames. The discrete Fourier transformation may then be performed, at 720, for each frame using the windows.

Based on the DFTs, the signal power spectrum ($P_y$ (r,w) 115) is computed at 725 and is subsequently used to estimate, at 730, the noise energy in each subband frequency at each frame ($P_n$ (r,w) 125) according to an estimation method described herein. Such estimated noise power spectrum is then used to compute, at 735, the dynamic over-subtraction factors for different frames according to the OSF estimation method described herein.

With estimated signal energy, and noise energy at each frame for each subband frequency, and the over-subtraction factor at each frame, a subtraction amount for each frequency at each frame can be calculated, at 740, using, for example, the formula described herein. The computed subtraction amount may then be used to subtract, at 745, from the original signal energy to produce a reduced energy spectrum. The reduced signal power spectrum and the phase information of the original input audio signal are then used to perform, at 750, an inverse DFT operation to generate an enhanced audio signal which may subsequently used for further processing or usage at 755.

Figure 8:
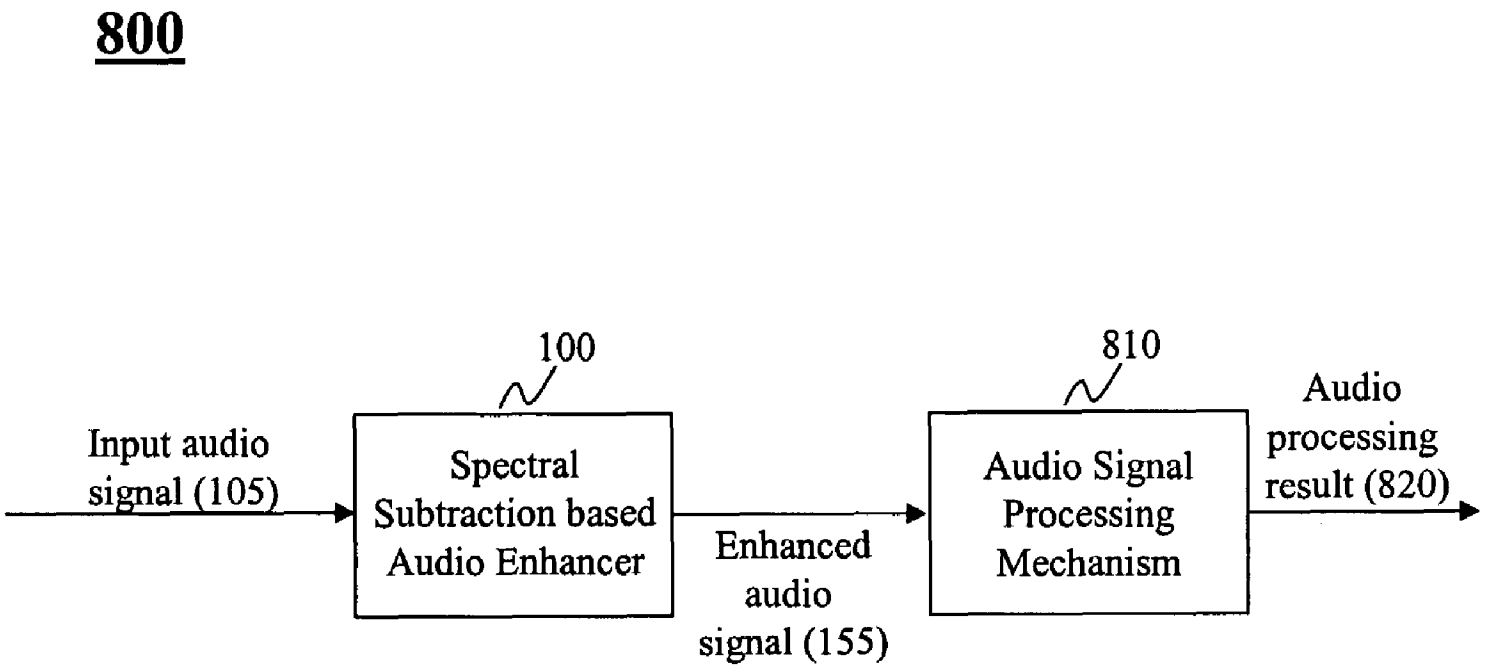
FIG. 8 depicts a framework in which a spectral subtraction based audio enhancement is applied to an audio signal prior to further processing, according to an embodiment of the inventions.

FIG. 8 depicts a framework 800 in which an audio signal is enhanced based on spectral subtraction based audio enhancement prior to being further processed, according to an embodiment of the inventions. The framework 800 comprises a dynamic spectral subtraction based enhancer 100, constructed according to the method described herein, and an audio signal processing mechanism 810. The input audio signal 105 is first processed by the dynamic spectral subtraction based enhancer 100 to produce an enhanced audio signal 155 with reduced noise power. The enhanced audio signal is then processed by the audio signal processing mechanism 810 to produce an audio processing result 820.

The dynamic spectral subtraction based enhancer 100 may be implemented using, but not limited to, different embodiments of the inventions as described above. Specific choices of different implementations may be made according to application needs, the characteristics of the input audio signal 105, or the specific processing that is subsequently performed by the audio signal processing mechanism 810. Different application needs may require specific computational speed, which may make certain implementation more desirable than others. The characteristics of the input audio signal may also affect the choice of implementation. For example, if the input speech signal corresponds to pure speech recorded in a studio environment, the choice of parameters used to estimate the noise power spectrum may be determined differently than the choices made with respect to an audio signal corresponding to a recording from a concert. Furthermore, the subsequent audio processing in which the enhanced audio signal 155 is to be utilized may also influence how different parameters are to be determined. For example, if the enhanced audio signal 155 is simply to be played back, the effect of musical tones may need to be effectively reduced. On the other hand, if the enhanced audio signal 155 is to be further processed for speech recognition, the presence of music tone may not degrade the speech recognition accuracy.

Figure 9:
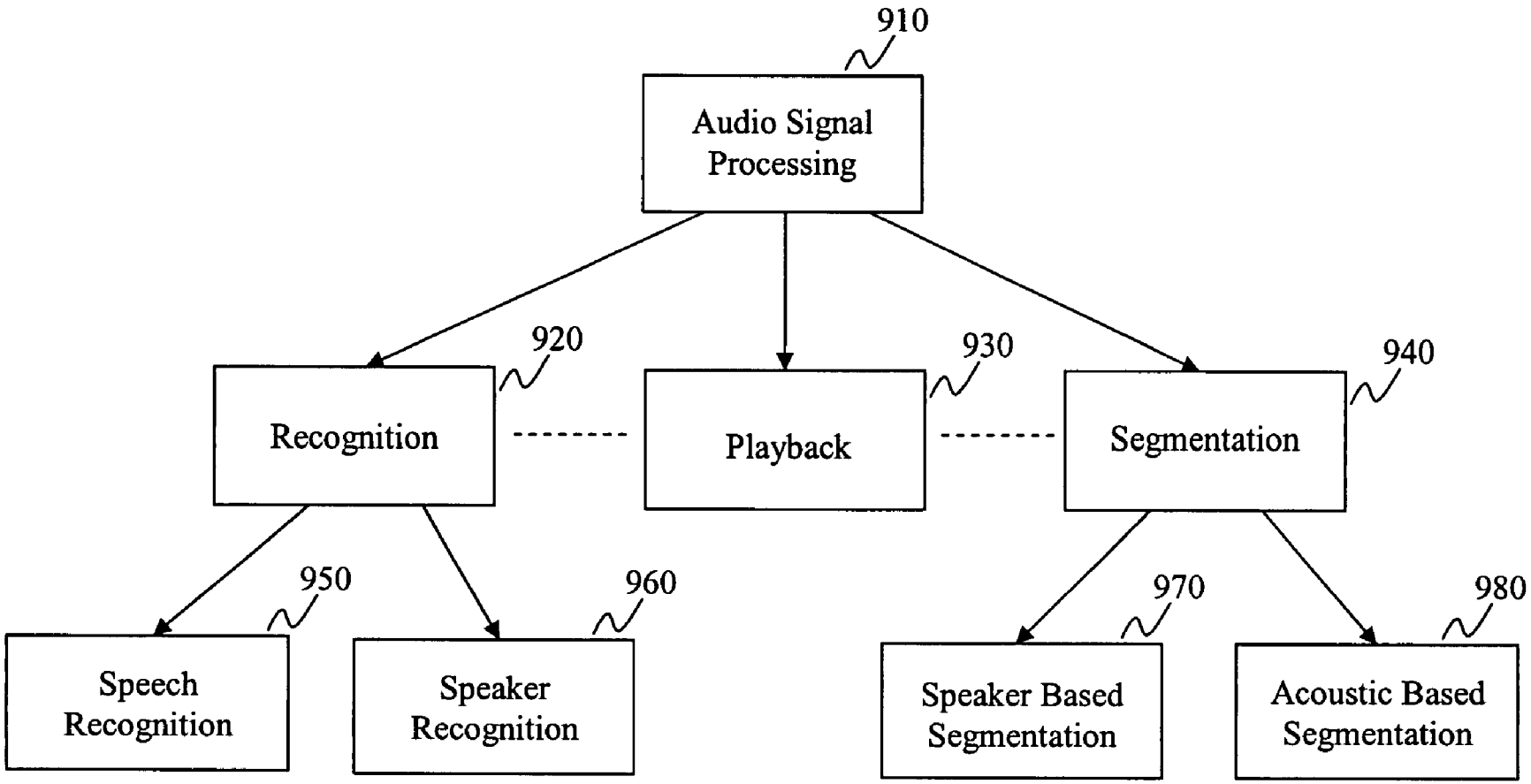
FIG. 9 illustrates different exemplary types of audio processing that may utilize an enhanced audio signal.

FIG. 9 illustrates different exemplary types of audio processing that may utilize the enhanced audio signal 155. Possible audio signal processing 910 may include, but is not limited to, recognition 920, playback 930, . . . , or segmentation 940. Speech recognition tasks 920 may include speech recognition 950, . . . , and speaker recognition 960. Speech based segmentation 940 may include, for example, speaker based segmentation 970, . . . , and acoustic based audio segmentation 980.

Figure 10:
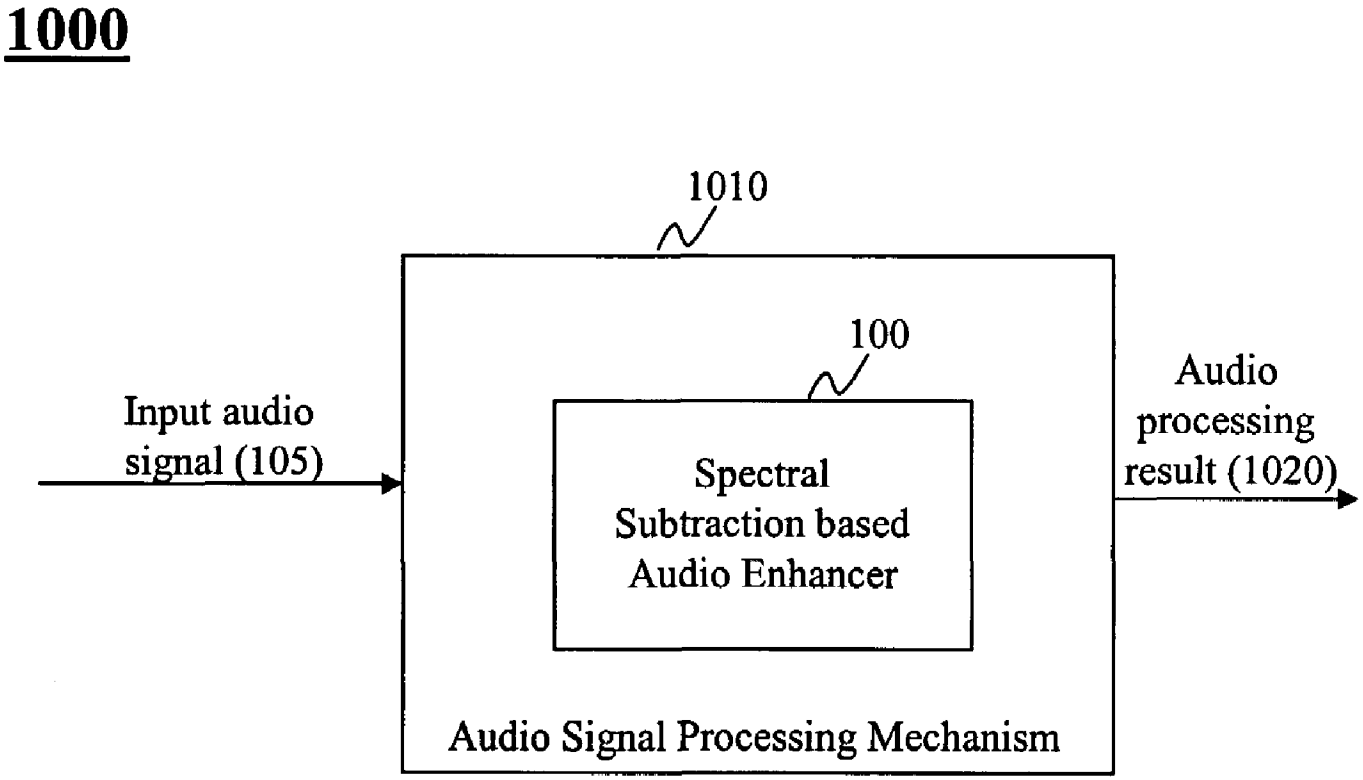
FIG. 10 depicts a different framework in which spectral subtraction based audio enhancement is embedded in audio signal processing, according to an embodiment of the inventions.

FIG. 10 depicts a different framework 1000, in which spectral subtraction based audio enhancement is embedded in audio signal processing, according to an embodiment of the present invention. An audio signal processing mechanism 1010 is embedded with a dynamic spectral subtraction based enhancer 100 that is constructed and operating in accordance with the enhancement method described herein. The input audio signal 105 is fed to the audio signal processing mechanism 1010, which may first enhance the input audio signal 105 via the dynamic spectral subtraction based enhancer 100 to reduce the noise present in the input audio signal 105 before proceeding to further audio processing.

While the inventions have been described with reference to the certain illustrated embodiments, the words that have been used herein are words of description, rather than words of limitation. Changes may be made, within the purview of the appended claims, without departing from the scope and spirit of the invention in its aspects. Although the invention has been described herein with reference to particular structures, acts, and materials, the invention is not to be limited to the particulars disclosed, but rather can be embodied in a wide variety of forms, some of which may be quite different from those of the disclosed embodiments, and extends to all equivalent structures, acts, and, materials, such as are within the scope of the appended claims.

We claim:

1. A method, comprising:

estimating the noise power spectrum for each frame of an audio signal based on a plurality of signal power spectrum values computed from a corresponding plurality of adjacent frames;

computing dynamically an over-subtraction factor for each frame of the audio signal based on the estimated noise power spectrum of the frame;

reducing the signal power spectrum of the audio signal at each frame in accordance with the over-subtraction factor computed for the frame.

2. The method according to claim 1, wherein said estimating the noise power spectrum comprises:

computing the signal energy for each sub frequency band of each frame of the audio signal;

deriving noise energy for each subband of each frame based on a plurality of signal energy values computed with respect to the same subband for a plurality of corresponding frames.

3. The method according to claim 2, wherein deriving the noise energy includes:

taking a minimum signal energy of each subband across a pre-determined plurality of adjacent frames as the estimated noise energy of the subband for the frame;

computing an average signal energy of a set of pre-determined percentage of the smallest signal energy values of the subband from a pre-determined plurality of adjacent frames as the estimated noise energy of the subband for the frame; and taking a signal energy value corresponding to a pre-determined percentile of the signal energy values of the subband from a pre-determined plurality of adjacent frames as the estimated noise energy of the subband for the frame.

4. The method according to claim 1, wherein said computing the over-subtraction factor comprises:

determining the signal to noise ratio of each frame based on the corresponding signal power spectrum and noise power spectrum computed and estimated for the frame; and deriving an over-subtraction factor for the frame based on the signal to noise ratio dynamically determined for the frame.

5. The method according to claim 4, wherein:

the signal to noise ratio of the frame is computed as $$SNR(r) = 10\log\left(\frac{\sum_w P_y(r, w) - \sum_w P_n(r, w)}{\sum_w P_n(r, w)}\right)$$

where SNR(r) represents the signal to noise ratio estimated for frame r, Py (r,w) represents signal energy of frame rat subband w, and Pn (r,w) represents noise energy of frame r at subband w; and the over-subtraction factor for the frame is computed based on the signal to noise ratio as:

$$OSF(r) = \frac{\varepsilon}{1 + \eta SNR(r)}$$

where OSF(r) represents the over-subtraction factor for frame r and □ and □ are pre-determined parameters.

6. The method according to claim 5, wherein said subtracting comprises:

computing a subtraction amount for each subband of each frame using the corresponding over-subtraction factor computed for the frame, the signal energy computed for the subband of the frame, and the noise energy computed for the subband of the frame; and subtracting the signal energy of the subband of the frame by the subtraction amount according to the following rule:

$$P_s(r, w) = \begin{cases} P'_y(r, w) - OSF(r) \times P_n(r, w) & \text{if } P'_y(r, w) - OSF(r) \times P_n(r, w) > 0 \\ \sigma & \text{if } P'_y(r, w) - OSF(r) \times P_n(r, w) \le 0 \end{cases}$$

where Ps (r,w) represents the subtracted signal energy at subband w of frame r and □ is a pre-determined constant.

7. The method according to claim 1, further comprising:

performing a Fourier transform on the audio signal prior to said estimating the noise power spectrum to produce a transformed signal based on which the signal power spectrum of the audio signal is computed; and performing a corresponding inverse Fourier transform, after said subtracting, using the subtracted signal power spectrum to produce an enhanced audio signal.

8. A method, comprising:

receiving an audio signal;

enhancing the audio signal to produce an enhanced audio signal via spectral subtraction using an over-subtraction amount dynamically computed based on the noise power spectrum of the audio signal estimated for each frame of the audio signal based on a plurality of signal power spectrum values of the audio signal computed from a corresponding plurality of adjacent frames; and utilizing the enhanced audio signal.

9. The method according to claim 8, wherein said enhancing comprises:

performing a Fourier transform on the received audio signal to produce a transformed signal;

estimating, based on the transformed signal, noise power spectrum for each frame of the audio signal based on a plurality of signal power spectrum values computed from a corresponding plurality of adjacent frames of the audio signal;

computing dynamically an over-subtraction factor for each frame of the audio signal based on signal to noise ratio computed for the frame based on the signal power spectrum and the noise power spectrum of the frame;

performing spectral subtraction of the signal power spectrum of the audio signal at each frame in accordance with the over-subtraction factor computed for the frame to produce subtracted signal power spectrum; and performing an inverse Fourier transform based on the subtracted signal power spectrum to produce the enhanced audio signal.

10. The method according to claim 9, wherein said estimating the noise power spectrum includes:

taking a minimum signal energy of each subband across a pre-determined plurality of adjacent frames as the estimated noise energy of the subband for the frame;

computing an average signal energy of a set of pre-determined percentage of the smallest signal energy values of the subband from a pre-determined plurality of adjacent frames as the estimated noise energy of the subband for the frame; and taking a signal energy value corresponding to a pre-determined percentile of the signal energy values of the subband from a pre-determined plurality of adjacent frames as the estimated noise energy of the subband for the frame.

11. The method according to claim 8, wherein said utilizing includes:

playing back the enhanced audio signal;

performing speaker identification based on the enhanced audio signal;

segmenting the audio signal based on the enhanced audio signal; and performing speech recognition on the enhanced audio signal.

12. The method according to claim 8, wherein said enhancing is an embedded operation of said utilizing.

13. A system, comprising:

a dynamic noise power spectrum estimation mechanism configured to estimate noise power spectrum using at least one signal power spectrum value of the audio signal computed for a corresponding plurality of adjacent frames of the audio signal;

an over-subtraction factor estimation mechanism configured to dynamically compute an over-subtraction factor for each frame of the audio signal based on the noise power spectrum estimated for the frame; and a spectral subtraction mechanism configured to reduce the signal power spectrum of the audio signal at each frame in accordance with the over-subtraction factor dynamically computed for the frame.

14. The system according to claim 13, wherein the dynamic noise power spectrum estimation mechanism comprises:

a signal power spectrum estimator configured to compute the signal energy for each sub frequency band of each frame; and a noise power spectrum estimator configured to derive noise energy for each subband of each frame based on a plurality of signal energies at the same subband computed for a corresponding plurality of adjacent frames, wherein the noise energy is computed as one of a minimum signal energy at each subband across a pre-determined number of adjacent frames.

15. The system according to claim 14, wherein the noise energy is computed as one of an average signal energy, averaged over a set of pre-determined smallest signal energy values at the subband computed from a pre-determined number of adjacent frames, and a signal energy corresponding to a pre-determined percentile across a pre-determined number of adjacent frames.

16. The system according to claim 13, wherein the over-subtraction factor estimation mechanism comprises:

a dynamic signal to noise ration estimator configured to determine a signal to noise ratio for each frame based on the corresponding signal power spectrum and noise power spectrum computed and estimated for the frame; and an over-subtraction factor estimator configured to derive an over-subtraction factor for each frame based on the signal to noise ratio determined for the frame.

17. The system according to claim 13, further comprising:

a preprocessing mechanism configured to perform a Fourier transform on the audio signal to produce a transformed signal based on which the signal power spectrum is computed; and an inverse Fourier transform mechanism configured to performing an inverse Fourier transform using the subtracted signal power spectrum to produce an enhanced audio signal.

18. A system, comprising:

a spectral subtraction based audio enhancer configured to enhance an audio signal to produce an enhanced audio signal via spectral subtraction using a subtraction amount dynamically computed based on noise power spectrum of the audio signal dynamically estimated based on at least one signal power spectrum value of the audio signal computed from a corresponding plurality of adjacent frames; and an audio signal processing mechanism configured to utilizing the enhanced audio signal.

19. The system according to claim 18, wherein the spectral subtraction based audio enhancer comprises:

a preprocessing mechanism configured to perform a Fourier transform on the audio signal to produce a transformed signal;

a dynamic noise power spectrum estimation mechanism configured to estimate, based on the transformed signal, noise power spectrum using at least one signal power spectrum values of the audio signal computed for a corresponding plurality of adjacent frames of the audio signal;

an over-subtraction factor estimation mechanism configured to dynamically compute an over-subtraction factor for each frame of the audio signal based on dynamic signal to noise ratio of the frame estimated based on the noise power spectrum estimated for the frame; and a spectral subtraction mechanism configured to reduce the signal power spectrum of the audio signal at each frame in accordance with the over-subtraction factor dynamically determined for the frame; and an inverse Fourier transform mechanism configured to performing an inverse Fourier transform using the subtracted signal power spectrum to produce an enhanced audio signal.

20. The system according to claim 18, wherein the spectral subtraction based audio enhancer is embedded in the audio signal processing mechanism.

21. An article comprising a storage medium having stored thereon instructions that, when executed by a machine, result in the following:

estimating the noise power spectrum for each frame of an audio signal based on a plurality of signal power spectrum values computed from a corresponding plurality of adjacent frames;

computing dynamically an over-subtraction factor for each frame of the audio signal based on the estimated noise power spectrum of the frame;

reducing the signal power spectrum of the audio signal at each frame in accordance with the over-subtraction factor computed for the frame.

22. The article according to claim 21, wherein said estimating the noise power spectrum comprises:

computing the signal energy for each sub frequency band of each frame of the audio signal;

deriving noise energy for each subband of each frame based on a plurality of signal energy values computed with respect to the same subband for a plurality of corresponding frames.

23. The article according to claim 22, wherein said deriving the noise energy includes:

taking a minimum signal energy of each subband across a pre-determined plurality of adjacent frames as the estimated noise energy of the subband for the frame;

computing an average signal energy of a set of pre-determined percentage of the smallest signal energy values of the subband from a pre-determined plurality of adjacent frames as the estimated noise energy of the subband for the frame; and taking a signal energy value corresponding to a pre-determined percentile of the signal energy values of the subband from a pre-determined plurality of adjacent frames as the estimated noise energy of the subband for the frame.

24. The article according to claim 21, wherein said computing the over-subtraction factor comprises:

determining the signal to noise ratio of each frame based on the corresponding signal power spectrum and noise power spectrum computed and estimated for the frame; and deriving an over-subtraction factor for the frame based on the signal to noise ratio dynamically determined for the frame.

25. The article according to claim 24, wherein:

the signal to noise ratio of the frame is computed as $$SNR(r) = 10\log\left(\frac{\sum_w P_y(r, w) - \sum_w P_n(r, w)}{\sum_w P_n(r, w)}\right)$$

where SNR(r) represents the signal to noise ratio estimated for frame r, Py (r,w) represents signal energy of frame rat subband w, and Pn (r,w) represents noise energy of frame r at subband w; and the over-subtraction factor for the frame is computed based on the signal to noise ratio as:

$$OSF(r) = \frac{\varepsilon}{1 + \eta SNR(r)}$$

where OSF(r) represents the over-subtraction factor for frame r and □ and □ are pre-determined parameters.

26. The article according to claim 25, wherein said subtracting comprises:

computing a subtraction amount for each subband of each frame using the corresponding over-subtraction factor computed for the frame, the signal energy computed for the subband of the frame, and the noise energy computed for the subband of the frame; and subtracting the signal energy of the subband of the frame by the subtraction amount according to the following rule:

$$P_s(r, w) = \begin{cases} P'_y(r, w) - OSF(r) \times P_n(r, w) & \text{if } P'_y(r, w) - OSF(r) \times P_n(r, w) > 0 \\ \sigma & \text{if } P'_y(r, w) - OSF(r) \times P_n(r, w) \le 0 \end{cases}$$

where Ps (r,w) represents the subtracted signal energy at subband w of frame r and □ is a pre-determined constant.

27. An article comprising a storage medium having stored thereon instructions that, when executed by a machine, result in the following:

receiving an audio signal;

enhancing the audio signal to produce an enhanced audio signal via spectral subtraction using an over-subtraction amount dynamically computed based on the noise power spectrum of the audio signal estimated for each frame of the audio signal based on a plurality of signal power spectrum values of the audio signal computed from a corresponding plurality of adjacent frames; and utilizing the enhanced audio signal.

28. The article according to claim 27, wherein said enhancing comprises:

performing a Fourier transform on the received audio signal to produce a transformed signal;

estimating, based on the transformed signal, noise power spectrum for each frame of the audio signal based on a plurality of signal power spectrum values computed from a corresponding plurality of adjacent frames of the audio signal;

computing dynamically an over-subtraction factor for each frame of the audio signal based on signal to noise ratio computed for the frame based on the signal power spectrum and the noise power spectrum of the frame;

performing spectral subtraction of the signal power spectrum of the audio signal at each frame in accordance with the over-subtraction factor computed for the frame to produce subtracted signal power spectrum; and performing an inverse Fourier transform based on the subtracted signal power spectrum to produce the enhanced audio signal.

29. The article according to claim 28, wherein said estimating the noise power spectrum includes:

taking a minimum signal energy of each subband across a pre-determined plurality of adjacent frames as the estimated noise energy of the subband for the frame;

computing an average signal energy of a set of pre-determined percentage of the smallest signal energy values of the subband from a pre-determined plurality of adjacent frames as the estimated noise energy of the subband for the frame; and taking a signal energy value corresponding to a pre-determined percentile of the signal energy values of the subband from a pre-determined plurality of adjacent frames as the estimated noise energy of the subband for the frame.

* * * * *